219-121 SR
10/25/83 XR 4,411,730

United States Patent [19]
Fishter et al.

[11] 4,411,730
[45] Oct. 25, 1983

[54] SELECTIVE CHEMICAL MILLING OF RECAST SURFACES

[75] Inventors: Robert E. Fishter, Boca Raton; Henry Lada, Lake Park, both of Fla.

[73] Assignee: United Technologies Corporation, Hartford, Conn.

[21] Appl. No.: 338,739

[22] Filed: Jan. 11, 1982

Related U.S. Application Data

[63] Continuation-in-part of Ser. No. 192,668, Oct. 1, 1980, abandoned.

[51] Int. Cl.[3] ..... C23F 1/00; B23K 9/00; C09K 13/04

[52] U.S. Cl. ..... 156/626; 156/628; 156/630; 156/634; 156/643; 156/656; 156/664; 219/121 EK; 219/121 LJ; 252/79.2

[58] Field of Search ..... 156/626, 627, 628, 631, 156/632, 630, 634, 643, 656, 664; 252/79.2; 219/121 EJ, 121 EK, 121 LH, 121 LJ

[56] References Cited

U.S. PATENT DOCUMENTS 3,866,398 2/1975 Vernon et al. ..... 219/121 LJ X
4,239,954 12/1980 Howard et al. ..... 219/121 EH
4,353,780 10/1982 Fishter et al. ..... 156/664

*Primary Examiner*—William A. Powell
*Assistant Examiner*—Thomas Bokan
*Attorney, Agent, or Firm*—C. G. Nessler

[57] ABSTRACT

Disclosed is a process for machining nickel-base superalloys wherein a thermal-effect process, such as laser or electric discharge machining, is first used to remove material but leaves a recast layer. Next a chemical milling process is used wherein the etchant only attacks and removes the recast layer. The etchant is comprised by volume percent of 40–60 $HNO_3$, 5–20 HCl, and balance $H_2O$, with which is included 0.008–0.025 moles/liter $FeCl_3$ and at least 0.016 moles/liter $CuSO_4$. The $FeCl_3$ improves removal rate but tends to cause unwanted pitting and intergranular attack. These tendencies are inhibited by the addition of $CuSO_4$; preferably the molar ratio of $CuSO_4$ to $FeCl_3$ is 2:1. The beneficial combination of $FeCl_3$ and $CuSO_4$ is usable in other etchants.

8 Claims, 8 Drawing Figures

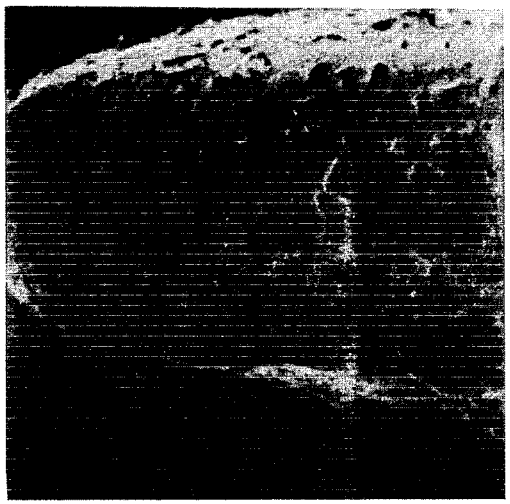
250 μm
FIG. 1b AFTER CHEM-MILL
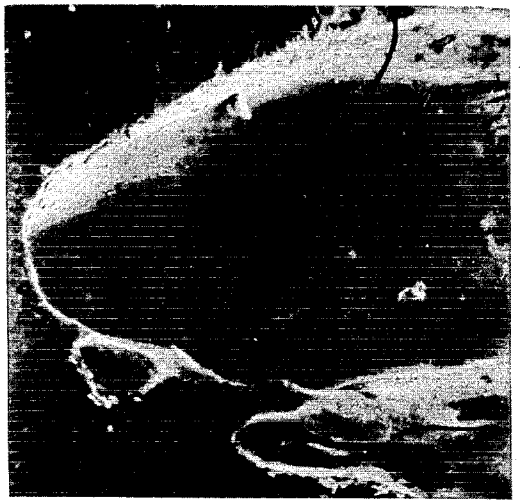
250 μm
FIG. 1a DRILLED

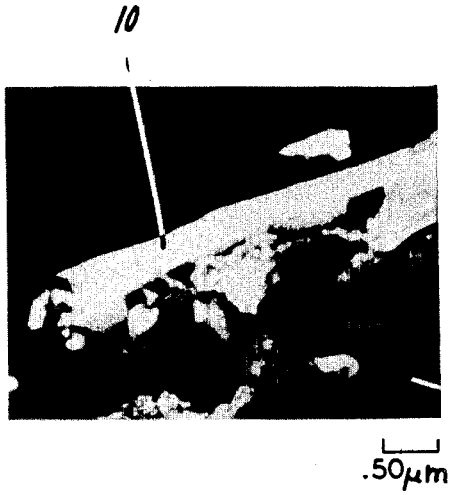
FIG. 2a DRILLED
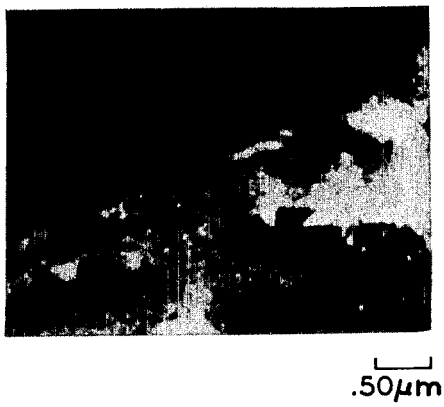
FIG. 2b AFTER CHEM-MILL

FIG. 3a EDM
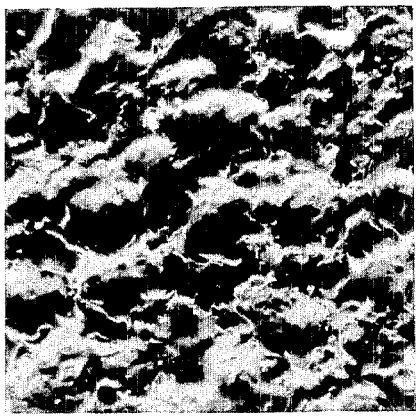
100μm
FIG. 3b AFTER CHEM-MILL
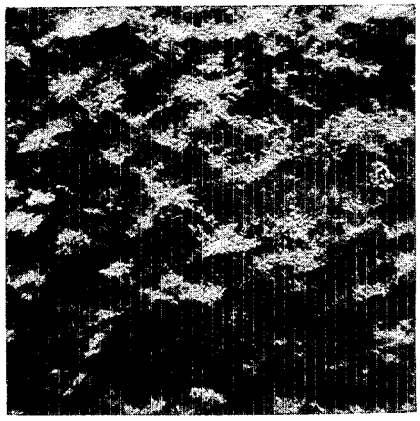
100μm
FIG. 4a EDM 20
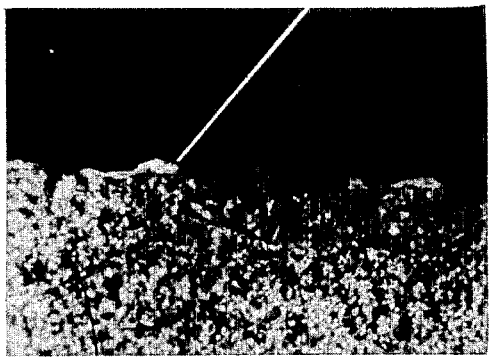
22 50μm
FIG. 4b AFTER CHEM-MILL
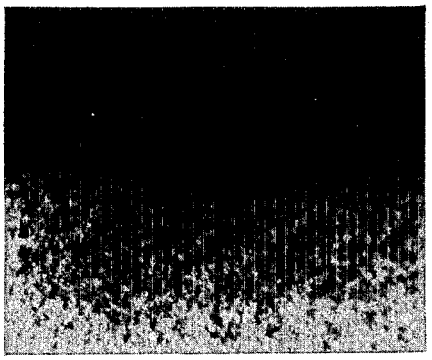
50μm

SELECTIVE CHEMICAL MILLING OF RECAST SURFACES

BACKGROUND

This is a continuation-in-part of Ser. No. 192,668 filed Oct. 1, 1980, now abandoned.

The present invention relates to the machining of superalloys by chemical milling in combination with thermal effect metal removal processes, such as those utilizing electric discharge and lasers.

As a class of materials, superalloys used in the manufacture of airfoils for gas turbine engines are quite difficult to machine by conventional metal cutting processes using tool bits and the like which convert metal into small chips. Two types of machining are particularly difficult: drilling fine holes through the walls of hollow airfoils, and providing a complex contoured three-dimensional surface shape, such as a pattern of grooves. As a result many innovative processes have been developed in the last few decades, including those utilizing steady and intermittent electric discharge, lasers, electron beams, electrochemistry and chemical attack.

However, many of these advanced processes have their disadvantages. As a class, the electrochemical and chemical processes suffer from a lack of precision, at least to the high tolerance required in many gas turbine engine components. Also most cast and wrought airfoil materials have some metallurgical inhomogeneities and a multiplicity of phases with different compositions. Resultant local variations in resistance to the chemical attack often can lead to undesirable irregular surface finishes, or in the worst case, preferential and excessive attack of certain areas such as grain boundaries resulting in an unusable fatigue crack prone surface. Consequently, the selection of etchants and electrolytes must be carefully considered and controlled, especially in chemical milling where the inherent corrosion resistance of the superalloys must be overcome with powerful etchants. The processes which utilize concentrated beam energy or electric discharge cause metal removal by very concentrated melting and vaporization; they are often capable of producing the requisite accuracy, but adverse metal workpiece.

To describe the problems more specifically by example, in making holes by laser or electron beam drilling, a beam is impinged in concentrated form on a cast airfoil workpiece surface until it penetrates through. In the process metal is melted and vaporized by the intense beam energy, creating the hole. The intensity of these processes is such that molten and vaporized metal is expelled from the hole being created, this effect being augmented by the use of a volatilizable backer material at the workpiece exit surface. However, there is usually nonetheless a small quantity of molten metal remaining at points along the periphery or length of the hole. When the beam energy is terminated this molten layer solidifies very rapidly. Thus not only is the metallurgical structure of this "recast" layer different from that of the more controllably cast and slowly cooled airfoil, but the resolidified or recast layer is often characterized by small cracks due to shrinkage. When airfoils with holes having recast layers are used, the imperfect recast layer structure tends to cause premature cracking of the airfoil due to fatigue, compared to the resistance to fatigue which the part would have if the holes lacked the deviant metallurgical structure. Naturally, a great deal of effort has been expended to modify the beam energy drilling processes to eliminate the recast layer, but while it has been minimized it has not been able to be eliminated.

Another example involves the production on a workpiece surface of a pattern of varying depth grooves and depressions. Electric discharge machining is a favored process to produce such surface contours, much as it is favored for three-dimensional die sinking. In electric discharge machining (EDM) a preformed electrode is placed in close proximity to the workpiece and electric spark discharge between the electrode and the workpiece causes vaporization and expulsion of material from the workpiece surface into a surrounding dielectric fluid. When surfaces machined by electric discharge are examined they also are found to have a recast layer comprised of material which was momentarily melted and remains adhered to the surface. Further, EDM surfaces are usually characterized by a certain roughness caused by the erratic nature of the spark discharge and in many instances it is desired to have a smoother surface than is typically producible. Of course, if a general secondary machining operation such as grinding is used to smooth an EDM surface the good accuracy from the EDM process can easily be lost, or costs will be increased.

Thus, it is very much desired to have a process which efficiently removes material but which leaves a surface finish nearly comparable to that of a conventional cast or machined surface.

SUMMARY OF INVENTION

An object of the invention is to machine a superalloy using a thermal effect process, but without leaving a recast layer or other imperfect surface.

According to the invention the recast layer may be selectively removed using chemical milling and an etchant having the composition by volume percent of 40–60 $HNO_3$, 5–20 HCl, and balance $H_2O$, with which is included 0.008–0.025 mole/l $FeCl_3$ and at least 0.016 mole/l $CuSO_4$. Preferably the etchant is 50 $HNO_3$, 10 HCl and 40 $H_2O$, with 1.3 g/l $FeCl_3$ and 2.6 g/l $CuSO_4$. The $FeCl_3$ improves removal rate but tends to cause unwanted pitting and intergranular attack. These tendencies are inhibited by the addition of $CuSO_4$; preferably the molar ratio of $CuSO_4$ to $FeCl_3$ is 2:1. The beneficial combination of $FeCl_3$ and $CuSO_4$ is usable in other etchants.

The etchant has a self-limiting feature that is very unique. Only the recast layer is removed and the removal of metal which is not recast is minimal. Gas is evolved during removal (preferably done at 40°–80° C.) and the cessation of evolution may be used as an indication of the completion of the chemical milling process.

The invention provides a rapid way for removing material from a superalloy since thermal effect processes are exceedingly fast and the chemical milling is very selective and also rapid. Machined superalloy surfaces with surfaces free from adverse metallurgical features are thereby provided.

The foregoing and other objects, features and advantages of the present invention will become more apparent from the following description of preferred embodiments and accompanying drawings.

BRIEF DESCRIPTION OF DRAWINGS

FIG. 1(*a*) is a planar surface view of the entrance of an oblique laser drilled hole showing a cracked recast layer;

FIG. 1(*b*) shows the hole entrance with the recast layer removed after chemical milling.

FIG. 2(*a*) is a partial longitudinal section through the hole of FIG. 1(*a*) showing the hole wall;

FIG. 2(*b*) shows the hole wall after chemical milling.

FIG. 3(*a*) is a planar surface view of a EDM surface showing the rough recast layer;

FIG. 3(*b*) is the surface after chemical milling.

FIG. 4(*a*) is a cross section through the surface shown in FIG. 3(*a*);

FIG. 4(*b*) is a cross section of the surface in FIG. 3(*b*).

BEST MODE FOR CARRYING OUT THE INVENTION

The invention is described hereafter in application to the nickel-base superalloy MAR M-200 +Hf, a nickel-base alloy having the composition by weight percent of 10 Co, 9 Cr, 2 Ti, 5 Al, 12 W, 1 Cb, 2 Hf, 0.15 C, 0.015 B, 0.05 Zr, balance Ni. Limited experiment indicates that the process will be useful for other nickel alloys, especially the superalloys such as IN-100, IN-718 and Astroloy.

In its preferred practice the invention was used to produce both holes of improved quality in airfoil walls, and contoured surfaces on superalloys. The hole drilling will be described first. About 10 holes of 0.7 to 1.3 mm diameter were drilled in the as-cast surface of a hollow airfoil wall workpiece having a thickness of about 2.5 mm; the holes were at different inclinations to the surface and thus ranged in length between 2.5 and 5 mm. A neodymium laser generated pulse radiation at 1.06 micron wavelength was applied to the workpiece entrance surface at an intensity of about $10^7$ watts/cm$^2$, with a pulse duration of about 660 microseconds and rate in the range 0.3 to 1 pulses/second. The exit side of the workpiece had applied thereto a backer of epoxy resin to both absorb energy when the wall is penetrated and prevent damage to other surfaces, and to aid in the expulsion of molted metal from the drilled hole. For the general functions and characteristics of desirable backers for electron beam drilling reference may be made to U.S. Pat. No. 4,239,954 of Howard et al.; the art for laser drilling is analogous. FIG. 1(*a*) is a view of the entrance of the drilled hole on the surface 16 of a workpiece. The beam has impinged on the surface so that the hole slants downward toward the left of the photograph. Around the entrance of the hole can be seen the recast layer 10, containing a prominent crack 12 as well as other cracks. Some other recast layer molten material 14 is on the surface surrounding the hole as well. FIG. 2(*a*) shows a portion of a longitudinal section through the same hole. The specimen has been etched to reveal microstructure and the recast layer 10 which is light colored and featureless compared to the more characteristic cast morphology of the base metal 18 which is more removed from the hole. The recast layer was non-uniform and varied in thickness from about 0.08 to 0.8 mm.

FIGS. 1(*b*) and 2(*b*) are analogous views to FIGS. 1(*a*) and 2(*a*), showing the workpiece after chemical milling which is described in more detail below.

Generally conventional EDM techniques are used to produce a pattern of grooves varying in depth from 2.4 to 2.9 mm and in width from 1.5 to 1.8 mm. But to better illustrate the invention, a rectangular parallel-piped test piece with an entirely EDM surface of about 1.61 sq.cm. on one face was produced. The EDM conditions were nominally: 80 volts DC; 3 amps; a pulse frequency of 3 kilocycles; a capacitance of 1 microfarad; using a carbon electrode with a mineral seal dielectric fluid (Exxon Mentor No. 28, Exxon Corp., Houston, Texas) at 27° C. The foregoing conditions are characteristic of those used for a light roughing mode of operation. To produce a piece with grooves a suitably shaped electrode is prepared, and the EDM parameters adjusted according to the area and other considerations in a manner familiar to those with skill in EDM.

The EDM produced a surface finish (as measured by a surface profilometer) of about 80–120 root mean square (RMS) micro inches. Of course better finishes can be obtained in EDM but with undesirably slow rate of material removal. The surface condition of a portion of the EDM surface is shown in planar view in FIG. 3(*a*) and in cross section in FIG. 4(*a*). In the latter figure the lighter recast layer 20 is evident in contrast to the unaffected base metal 22, similarly to the appearance of the laser drilled holes. The recast layer varied in thickness from 0.08 to 0.8 mm.

Removal of material by either laser or EDM are designated herein as "thermal effect processes". By this we mean they are processes in which metal is removed by heating above its melting point and wherein there is a residual recast layer on the workpiece surface. Thus we embrace in the scope of our invention other thermal effect processes including but not limited to those mentioned in the Background.

Both the workpiece with the laser drilled holes and that with the EDM surface were separately immersed in a chemical etchant. The composition of the etchant was as follows:

Conc. $HNO_3$ (69–71%): 1892 ml (50 v/o)
Conc. HCl (36.5–38%): 375 ml (10 v/o)
$H_2O$: 1500 ml (40 v/o)
$FeCl_3$: 1.3 g/l (0.008 mole/l)
$CuSO_4$: 2.6 g/l (0.016 mole/l)

The workpiece having the laser drilled holes was immersed in the etchant at 77° C.; after initially observed gas evolution ceased, the workpiece was removed from the etchant and examined. As shown in FIGS. 1(*b*) and 2(*b*) the recast layer was completely removed from the drilled holes. There was some small degree of general attack on the non-recast areas of the workpiece as evidenced by the Figures and examination showed the 6.55 gm workpiece had lost only about 0.118 gm or 1.8% of its original weight. Thus, the substantial effect of the chemical milling was to only the recast layer, and more uniform, smooth, and crack-free holes were provided.

The workpiece with EDM portions was immersed in the electrolyte at 66° C. and heavy gas evolution was evident from the EDM areas. After about 5 minutes the gas evolution substantially ceased and the workpiece was removed. Comparative examination produced the data in Table 1. Basically, only the recast layer was removed and the other parts of the test piece were not affected. The height dimension, defined at one end of the part by the sole EDM surface and at the opposing end by an ordinary machined surface, has a change indicative of the removal of the recast layer and smoothing. The other dimensions, length and width, are indicators of the lack of substantial effect of the process on non-EDM surfaces. Electron micro probe measurement of the surface showed the concentration of W increased and that of Cr decreased slightly (about 20% change for each). This is a superficial effect and regarded as minor in consequence.

TABLE 1

| Comparative Measurements on EDM Workpiece Subjected to Chemical Milling | | | |
|---|---|---|---|
| Feature | Before Milling | After Milling | Change |
| Surface Finish (RMS micro-inch) | 80-120 | 40-60 | −50 |
| Length-mm | 11.151 | 11.138 | −0.013 |
| Height (EDM surface)-mm | 9.779 | 9.728 | −0.051 |
| Width-mm | 5.982 | 5.982 | −0.0000 |
| Surface Chemistry-EDM area | Tungsten Rich | Depleted in tungsten and chromium | |
| Surface Chemistry-Base Metal | Nominally within Specification | Nominally within Specification | |

A very striking aspect of the invention is the self-limiting nature of the chemical milling portion of the process. The evolution of gas (hydrogen) is evidence of substantial metal removal; thus when the gas evolution substantially ceases the quantity of metal being dissolved per unit time is substantially reduced. We have not run sufficient detail experiment, but if the workpiece was maintained in the solution some further gradual and general dissolution probably will take place, given the corrosive nature of the etchant. However, for practical purposes the process is self-limiting and the near-cessation of gas evolution gives a signal that the removal of the undesired recast material is complete. While we made visual observation to sense the diminution of gas evolution, physical or chemical gas sensing devices may be alternately used to signal or automatically effect removal of the workpiece from the etchant, for best efficiency and avoidance of minor attack. Another desirable aspect of the process is that the workpiece is left with an improved surface finish and that the corrosive attack of the workpiece in the areas which are not recast is minimal.

The exact mechanism which provides the chemical milling with its self-limiting feature is not evident. However, it is dependent on the constituents, as there are many seemingly similar electrolytes which do not produce this desired result, including that described in our Patent No. 4,353,780 "Chemical Milling of High Tungsten Content Superalloys" now U.S. Pat. No. 4,353,780. (As a matter of note, tungsten segregation in normally cast MAR M-200 base metal, the effects of which the related invention overcomes, does not occur in the rapidly quenched recast layer.) The chemical differences between the recast layer and unaffected workpiece substrate are not very great, although they may contribute to the effect observed. Another speculation is that the rapid cooling rates associated with the thermally effected layers produce a metallurgical structure which is more susceptible to corrosion due to its structure, compared to the more slowly cooled and presumably more equilibrated workpiece structure.

Based on our experiments we believe that the electrolyte constitutes may be varied within the following range: by volume percent, 40-60 $HNO_3$, 5-20 HCl, balance $H_2O$, in combination with 0.016-0.083 moles/-liter $CuSO_4$ and 0.008-0.025 moles/liter $FeCl_3$; where the acids are 69-71% conc. nitric acid and 36.5-38% conc. hydrochloric acid.

In our etchant we include ferric chloride as an additional corrodent to speed the rate of material removal. However, the use of the acids by themselves or in combination with the $FeCl_3$ results in pitting and uneven attack of the material being removed; especially, the grain boundaries are attacked. The addition of $CuSO_4$ above the minimum amount prevents this unwanted attack. As indicated, our solution described only slightly attacks the base metal. However, we have noticed that in the absence of $CuSO_4$, the slight attack of the base metal is accelerated preferentially at the grain boundaries. Preferably the molar ratio of $CuSO_4$ and $FeCl_3$ is 2:1. $FeCl_3$ should not be added beyond the indicated range, regardless of the amount of $CuSO_4$, because the inhibiting action of $CuSO_4$ will not be sufficient. On the other hand, the amount of $CuSO_4$ may be increased beyond the indicated range since it is benign. We believe that the combination of $FeCl_3$ and $CuSO_4$ to be novel and significant in chemical removal of nickel base superalloys.

The moderately elevated temperature we used is desirable to increase the rate of reaction; apart from our nominal best temperature of 66° C., the process is believed operable between 40°-80° C., and we prefer to operate in the range of 60°-70° C.

Our invention, as described, combines laser or EDM with uniquely selective chemical milling. Generally, our invention combines a thermal effect process with chemical milling using a specialized etchant. In its best use it provides precision machining and quality of surface condition in nickel alloys, but it will be applicable to other nickel alloy material processing using a thermal effect process where the recast layer is undesirable.

While chemical milling is preferably carried out by immersion as described above, other modes of application may also be utilized. Additionally, wetting agents, thickners and so forth may be included with our etchant, as the user is inclined.

Although this invention has been shown and described with respect to a preferred embodiment, it will be understood by those skilled in the art that various changes in form and detail thereof may be made without departing from the spirit and scope of the claimed invention.

I claim:

1. Machining the surface of a nickel-base superalloy workpiece by the process which comprises:

removing workpiece material using a thermal-effect process which causes melting and vaporization of metal, thereby leaving on the workpiece surface a recast layer; and contacting the surface from which material is removed with an etchant comprised by volume percent of 40-60 $HNO_3$, 5-20 HCl, balance $H_2O$, at least 0.016 moles/liter $CuSO_4$ and 0.008-0.025 moles/liter $FeCl_3$, thereby chemically dissolving the recast layer without substantially removing other workpiece surface material.

2. The process of claim 1 wherein the thermal-effect process is one utilizing beam energy, such as from a laser or electron beam.

3. The process of claim 1 wherein the thermal-effect process is one utilizing an electric discharge.

4. The process of claim 2 wherein the removal of material produces holes in the workpiece.

5. The process of claim 1 wherein the etchant is maintained at 40°-80° C. and which further comprises sensing the completion of removal of the recast layer from a substantial diminution in the evolution of gas at the workpiece.

6. The process of claim 1 wherein the molar ratio of $FeCl_3$ and $CuSO_4$ is maintained at 1:2.

7. The process of claim 1 wherein the etchant consists by volume percent of about 50 $HNO_3$, 10 HCl, 40 $H_2O$, with 1.3 g/l $FeCl_3$ and 2.6 g/l $CuSO_4$.

8. The process of claims 1 or 7 where in the superalloy is based on the alloy consisting by weight percent of 10Co, 9Cr, 2Ti, 5Al, 12W, 1Cb, 0.15C, 0.015B, 0.05Zr, balance Ni.

* * * * *